US005908141A

United States Patent [19]

Teel

[11] Patent Number: 5,908,141

[45] Date of Patent: Jun. 1, 1999

[54] METHOD AND SYSTEM OF HYDRAULICALLY-PRESSURIZING NATURAL GAS AT A RESIDENCE TO RE-FUEL NATURAL GAS VEHICLES

[76] Inventor: James R. Teel, P.O. Box 208, Bull Shoals, Ark. 72619

[21] Appl. No.: 09/039,272

[22] Filed: Mar. 12, 1998

[51] Int. Cl.[6] ..... B65B 1/04

[52] U.S. Cl. ..... 222/3; 222/389; 141/2; 141/18; 141/21; 141/25

[58] Field of Search ..... 222/3, 386.5, 389, 222/95, 105, 146.5; 141/18, 114, 25, 26, 28, 39, 67, 82, 231, 21, 2, 4; 137/267

[56] References Cited

U.S. PATENT DOCUMENTS 5,603,360 2/1997 Teel ..... 141/114

5,676,180 10/1997 Teel ..... 141/18

*Primary Examiner*—Steven O. Douglas

[57] ABSTRACT

A method and system for re-fueling natural gas vehicles, at home, utilizing a hydraulic pressurization-chamber instead of a conventional mechanical compressor, to boost low-pressure gas (usually about 1 psi) up to the 3500–4000 psi required to re-fuel automotive equipment. This Residential Refueling Facility (RFF) will acquire natural gas from a residential public utility gas line into a flexible bladder located inside a steel high-pressure vessel where it will be pressurized by pumping a hydraulic fluid into the annulus between the outside of the bladder and the inside walls of the steel vessel. When the increased pressure reaches a level above the pressure existing in the on-board storage tanks on the vehicle being re-fueled, the gas in the bladder will be squeezed out to the on-board storage tank. The process is then repeated until the on-board storage tanks are filled.

1 Claim, 1 Drawing Sheet

METHOD AND SYSTEM OF HYDRAULICALLY-PRESSURIZING NATURAL GAS AT A RESIDENCE TO RE-FUEL NATURAL GAS VEHICLES

CROSS-REFERENCES TO RELATED APPLICATIONS

U.S. patent application Ser. No. 08/454,531, now U.S. Pat. No. 5,603,360 U.S. Pat. application Ser. No. 08/615,690, now U.S. Pat. No. 5,676,180

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention is classified as a Residential Fueling Facility (RFF) by the National Fire Prevention Association (NFPA), and relates to a method and system of compressing natural gas at a residence to re-fuel natural gas vehicles. More particularly, it relates to such a method and system especially adapted to the economics of the equipment used to increase the pressure (to pressurize or compress) the gas from a residential gas supply line up to the 3500–4000 pounds per square inch (psi) required to re-fuel on-board storage tanks on natural gas vehicles. The present invention relates, specifically, to the use of a flexible bladder, inside a steel vessel, to receive, and temporarily-store, natural gas from a residential gas supply line. In order to increase the pressure of the temporarily-stored gas inside the bladder, a hydraulic fluid is pumped into the annulus between the outer walls of the bladder and the inner walls of the steel vessel. With continued pumping, the pressure of the hydraulic fluid will exceed the gas pressure inside the bladder and the bladder collapses in size which results in the gas inside the reduced-size container (the bladder) being elevated to a higher pressure. The higher-pressured gas can then be transferred to a compressed natural gas (CNG) storage tank on-board the vehicle being refueled. In the absence of an internal flexible bladder to pressurize the gas, a more-expensive mechanical compressor would have to be used, which would increase the cost to the residence-owner and make it more difficult to re-fuel automotive equipment at home.

The conventional manner of pressurizing (compressing) natural gas, at home, is to utilize commercially-available RRF units which utilize conventional mechanical compressors to boost the pressure of the gas up to the 3500–4000 psi level required to re-fuel on-board storage tanks in natural gas vehicles, which are so expensive as to make the use of CNG to re-fuel vehicles non-competitive with fuels such as gasoline and diesel to re-fuel automotive equipment.

The present invention is intended to solve the need for a more-economical method of pressurizing (compressing) natural gas from the low-pressure available at the standard household gas utility line of approximately 1 psi, which must be boosted up to the 3500–4000 psi level utilizing a multi-stage mechanical compressor. The desired economics are possible due to the elimination of the multi-stage compressor and to replace the compressor with a self-contained pressurization chamber composed of a steel cylinder, a flexible bladder inside the steel cylinder, and a hydraulic system (pump, prime-mover, surge tank) to pump a hydraulic fluid in the annulus between the bladder and the steel walls of the cylinder.

The flexible bladder is a one-piece cylinder-liner which, when filled with gas from the gas supply line, will inflate substantially to the interior walls of the steel cylinder, which will be sized to accommodate the volume of gas required to re-fill the on-board storage tanks of two natural gas vehicles in a slow-fill period (usually approximately 5 hours). The bladder is made of rubberized nylon, or if, by choice, some other member of the elastomer family of synthetic rubbers, compatible with natural gas, fresh water/anti-freeze mix, or mineral hydraulic oil, with one domed-end, the other end open and attached (bonded) to the face of a flange attached to the steel cylinder.

The hydraulic fluid is a matter of choice and can be either a water/anti-freeze mix, or a hydraulic mineral oil.

The present invention is particularly designed for more-economical at-home pressurization of natural gas for natural gas vehicles, utilizing a hydraulic pump instead of a mechanical compressor. While primarily designed for home use, the invention can also serve as a more-economical method of re-fueling natural gas vehicles while at work in business and commercial buildings; in commercial buildings to fuel fork-lift trucks; at airports to re-fuel airline baggage and passenger transports; and generally any other method of transportation involving gasoline/diesel fuels.

BRIEF SUMMARY OF THE INVENTION

In the method and system of the invention, a Residential Refueling Facility (RRF) consists of gas loading and unloading conduits, gas control mechanisms, pressure and temperature measuring devices, a bladder-equipped steel cylinder pressurization unit, and hydraulic system (pump, prime-mover, and surge tank). The unit is pre-packaged, skid-mounted, and is usually installed outside the residence near a garage door. All controls are remotely-located inside the garage, or some other secure area. A low-pressure gas line (supplied by the local gas utility) will be connected to the RRF.

Start-up operations will commence with an "on-off" switch which, when placed in the "on" position will enable the control panel to signal the valve on the gas supply line to open and gas to flow to the suction of a low-pressure, low-volume, booster compressor, and from there to the interior of of the bladder. When the amount of gas necessary to fill the bladder is confirmed by a sensor, the fill valve will close and a signal sent to the pressure pump on the hydraulic system to pump hydraulic fluid into the annulus between the bladder and steel cylinder. When the pressure in the annulus exceeds the pressure of the gas in the on-board storage tank, a signal will open the valve to the on-board storage tanks and the gas inside the bladder will be forced out to the on-board storage tanks in one or two vehicles, simultaneously, or individually, as the choice may be. When the displacement is finished, the valve on the on-board storage tank will be closed and the pressure in the annulus released back to the surge tank. The cycle is then repeated a sufficient number of times to transfer a sufficient amount of gas from the gas supply line to the on-board storage, at the necessary pressures. Upon reaching a pre-set pressure in the on-board storage tanks, the process will be shut down automatically.

It is the principal object of the present invention to provide a method and system for economically transferring low-pressure natural gas from a residential gas supply to on-board storage tanks, at pressures necessary to re-fuel natural gas vehicles, without the use of multi-stage compressors. The key to obtaining this objective is to modify an approved CNG storage vessel by inserting a flexible bladder, the same size as the internal walls of the pressurization cylinder, which will maintain separation of the gas and a hydraulic fluid which is injected into the annulus to collapse the bladder and increase the pressure of the gas sufficient for it to flow to the on-board storage tanks. The desired object will be obtained by utilizing a hydraulic pump to pressurize a closed hydraulic system to pressures above the pressure of the gas inside the bladder. As the pressurized fluid is injected into the annulus between the bladder and the steel walls, the pressure differential will compact the bladder, reducing the internal volume, with a resultant increase in pressure of the gas inside the bladder. The resultant increase in pressure will have been obtained without the use of a conventional gas compressor.

BRIEF SUMMARY OF THE DRAWINGS

Other objects and many attendant advantages of the present invention will become apparent from the following Description of the Preferred Embodiment, when taken in conjunction with accompanying drawing.

DETAILED DESCRIPTION OF THE INVENTION

Figure 1:
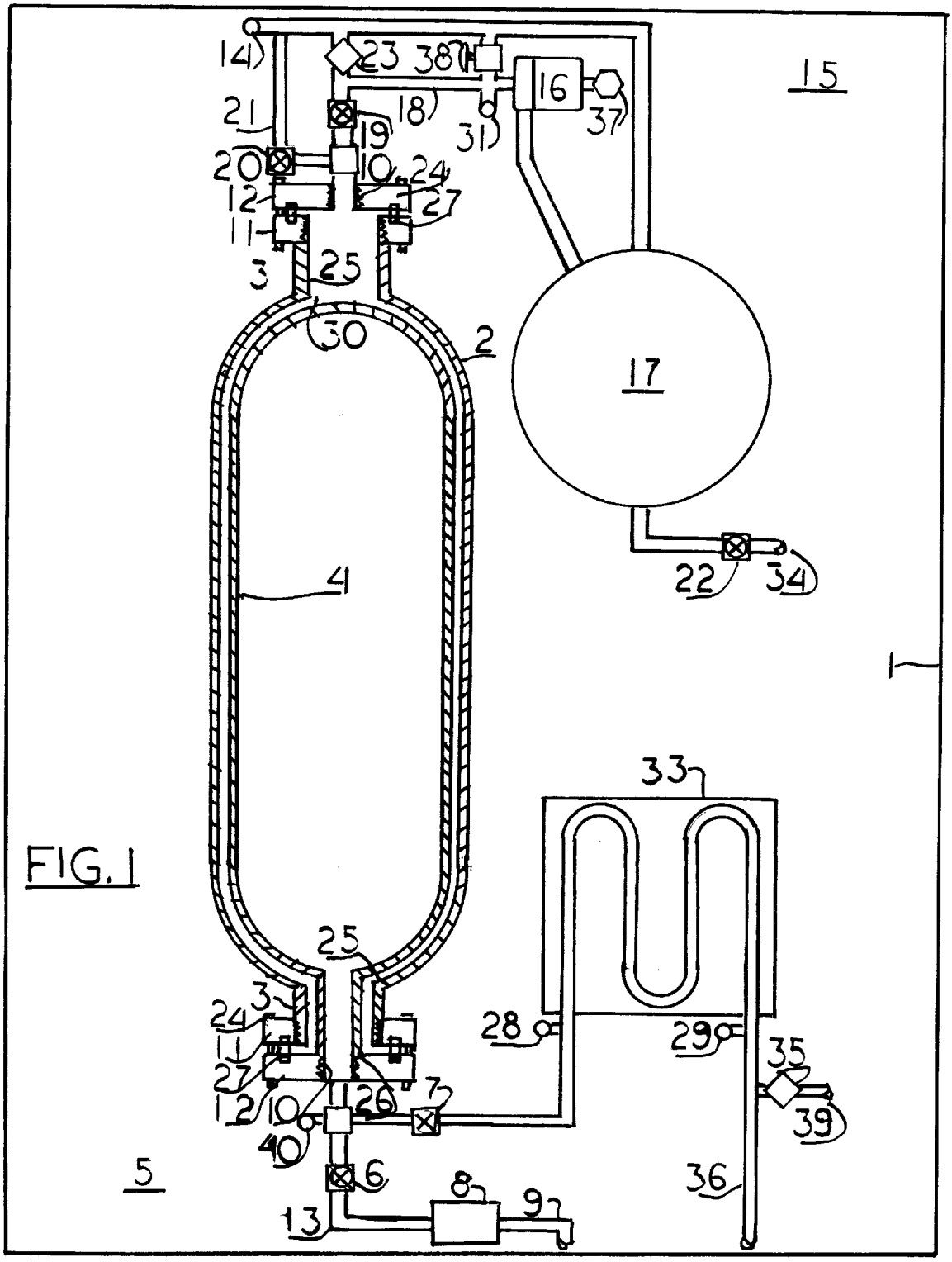
FIG. 1 is a diagrammatic view (top) of a skid-mounted Residential Fueling Facility (RFF).

In U.S. patent application Ser. No. 08/454,531, now U.S. Pat. No. 5,603,360, filed by the same inventor of this invention, there is disclosed a method and system for transporting natural gas, from a gas pipeline, to a compressed natural gas (CNG) re-fuel station, inside of a flexible bladder within a steel cylinder, and to discharge the transported gas into storage at a CNG re-fuel station with the aid of a hydraulic pump instead of an expensive compressor.

In U.S. patent application Ser. No. 08/615,690, now U.S. Pat. No. 5,676,180, filed by the same inventor of this invention, there is disclosed a method and system for storage and transfer of stored gas to a dispenser to re-fuel automobiles, trucks, and busses.

It should be noted that the present invention utilizes a bladder-squeeze technique such as that disclosed in U.S. Pat. Nos. 5,603,360 and 5,676,180, to pressurize natural gas for re-fueling natural gas vehicles, except that the gas will be pressurized, at home, or at some location other than a re-fuel station, at extremely low pressure of the gas from public utility gas lines at the residence (usually about 1 psi). Also, it is important to know that the home re-fueling facility approved by the National Fire Protection Association (NFPA) must fill the on-board storage tank directly without any intermediate storage.

The method and system are especially effective for pressurizing small volumes of gas, at extremely low inlet pressures (approximately 1 psi), by alternately filling and emptying a collapsible bladder located inside a steel vessel (i.e., the pressurization chamber) a sufficient number of times to fill the on-board storage tanks. Operations of the system can be automated and sensor-controlled such that attendance is not required except to insert and disconnect the fill-nozzles. Safety devices will shut down the equipment in the event of a mal-function.

The method and systems are especially effective for periodic re-fueling of CNG vessels, at home, however, it is understood that the present method and system can be utilized to satisfy other end-user needs, such as at apartments, business buildings, and factories where automotive equipment is parked, un-used, for part of a day.

The value of the invention for CNG home-re-fills flows from the several features thereof. First of all, by eliminating the need for mechanical compressors to elevate the pressure of the gas to re-fuel requirements (3500–4000 psi), the substitution of a lesser cost hydraulic pressurization method of boosting the gas pressure will have substantial initial cost savings and future operating costs will be less, and there will be more economic incentive to replace gasoline/diesel with CNG as the primary fuel for automobiles, busses, and trucks.

Referring now to the Drawing, FIG. 1 is the basic Residential Refueling Facility (RFF). The skid-mounted unit generally at (1) contains a hydraulic pressurization vessel (2) which is generally constructed to satisfy municipal codes for construction and operation of high-pressure vessels for storage of compressed natural gas in municipalities. The pressurization-vessel (2) is a seamless steel cylinder of American Society of Mechanical Engineers (ASME) SA-372 material, Type IV, with sufficient wall thickness to contain working pressures up to 4000 psi with a safety factor of 3 (per ASME specifications for Boiler and Pressure Code, Section VIII, Division 1) with threaded outlets on each end (3) with internal dimensions of approximately 9.5 inches to accommodate the insertion of a flexible bladder (4) inside the cylinder (2). The bladder (4) is a one-piece tube of elastomer material of conventional design with an external surface area approximately the same as the internal surface area of the steel cylinder (2) into which it is inserted so that when natural gas is injected into the bladder (4), it will expand and conform to the shape of the interior of the steel tube (2). As the pressure of the confined gas in the bladder (4) increases, the pressure will be contained by the steel walls of the cylinder backing-up the bladder (4) material.

On one end of the skid (1), generally at (5) is a natural gas loading and unloading system consisting of conduits (32) and (13), respectfully, an entry-control valve (6), and an exit control valve (7), and a conventional low-pressure, low volume gas-booster apparatus (8) and conduit (13) to city utility gas service line. Also, generally at (5) conduit (32) extends to control valve (7) and on to a heat-exchanger (33). Temperature gauge (28) measures the inlet temperature of the gas into the heat-exchanger(33), and temperature gauge (29) measures the outlet temperature. Conduit (36) connects to re-fueling hoses (not shown) and to an emergency pressure relief valve (25) which is connected to a pressure-relief conduit (39). Also, generally at (5), the pressure-control flanges (11), the inner flange (12), the outer flange, provide gas entry access to the interior of the bladder (4) inside the steel pressurization chamber (2). Gas exit, following pressurization, is accomplished by closing the entry valve (6), and opening the exit valve (7) which is connected to conduit (32) through the conventional heat-exchanger (33). The inner flange (11) is connected to the pressurization chamber (2) by a threaded nipple (25), and is also connected to the companion outer flange (12) by bolts (24). Pressure is contained between flanges (11) and (12) by a ring-gasket (27).

On the opposite end of the skid (1), generally at (15), is a hydraulic gas-pressurization apparatus consisting of a hydraulic pump and prime-mover (16), a surge tank (17), and a conduit(18), whereby hydraulic fluid is pumped through a conduit (18) to entry control valve (19) and on the outer face of flange (12), where conduit (18) is attached to a threaded outlet (10). The inner flange (11) is attached to the pressurization chamber (2) by a threaded nipple (25) which is also connected to the companion outer flange (12) by bolts (24) and pressure is contained by a ring-gasket (27) between the two flanges (11) and (12). Gas pressurization is obtained when hydraulic fluid is pumped by the hydraulic pump (16), through conduit (18), and control valve (19) into the annulus (30) between the gas-filled bladder (4) and the inner walls of the steel pressurization chamber (2), where continued hydraulic pressure increase will collapse the bladder (4) and squeeze the gas out of the bladder (4) to the gas exit apparatus on the opposite end of the steel pressurization chamber (2). After pressurization, the hydraulic fluid is released back to the surge tank (17) through discharge valve (20) and conduit (21). Emergency pressure relief is available through valve (23) where gas could be exhausted to the atmosphere through conduit (14). Valve (22) and conduit (34) provide an outlet to drain the surge tank (17) if necessary.

The present invention contemplates pressurizing natural gas, available at a residence, from a city utility gas line at low pressure (usually 1 psi or less), up to the 3500–4000 psi required to re-fuel natural gas vehicles. The method of the invention is to accomplish the pressurization requirements without the use of expensive mechanical compressors, by creating a flexible pressurization chamber which can be evacuated using hydraulic fluid instead of a gas compressor.

The manner in which the pressurization system functions to carry out the method is believed to be evident from the above description thereof. In order to perform a typical residential automotive re-fuel operation, over a period of several hours (usually referred to as a "slow-fill"), gas from the city utility line is taken into the empty bladder (4) inside the pressurization chamber (2), the annulus (30) of which is full of hydraulic fluid that had been used to collapse the bladder (4) in the prior cycle. A small low-pressure, low volume gas booster apparatus (8) is used to elevate the pressure in the bladder (4) sufficient to extend the bladder (4) to the wails of the pressurization chamber (2) thereby forcing the hydraulic fluid in the annulus (30) to be displaced out to the surge tank (17). When the bladder (4) will not take on any more gas from the supply line (pressures equalized), the gas inlet diverter valve (6) is closed, thereby trapping gas inside the bladder (4). The hydraulic pump (16) is opened to the annulus (30) of the pressurization chamber (2) through control valve (19) and continues to pump against the pressure inside the bladder (4) causing it to collapse and squeeze gas into ever-decreasing volumes until the trapped gas pressure exceeds the pressure of the gas in the on-board storage tanks of the CNG vehicle being re-fueled. At the time the gas in the bladder (4) is opened to the conduit (32), through the heat-exchanger (33) and on to the vehicle being re-fueled (not shown), by closing gas inlet valve (6) and opening gas exit valve (7). This completes one cycle in the process and as each increment of gas, at ever-increasing pressures, continues to be transferred from the gas supply line to the CNG vehicle, the pressure will continue to build in the on-board storage tanks. When the maximum-set pressure in the on-board storage tanks is reached, the process will be automatically shut down.

It is believed apparent from the above how the present method of pressurizing natural gas can be adapted for other uses than to re-fuel natural gas vehicles at home (residences). Other end-uses could be to re-fuel natural gas vehicles at work; to re-fuel off-road vehicles such as motorboats, all-terrain vehicles, snowmobiles, ski-do's, and could be transported out to an isolated gas well without a pipeline connection, to pressurize natural gas which could be sold.

The present method and system fulfills all of the objects set forth herein above for the invention, and make it the best possible way to economically pressurize natural gas at residences to re-fuel automobiles and off-road vehicles located at the residence. Thus, the availability of natural gas, the environmentally-preferred fuel for automobiles, trucks, and busses, can be such that it can economically compete with gasoline and diesel for automotive fuel use. In addition, the increased use of natural gas as the primary fuel for the personal home-work vehicles will open other further opportunities to reduce the amount of crude oil used to make gasoline, which, in turn, will reduce the nation's reliance on foreign crude oil as the primary source of domestic energy requirements. The reduced reliance on foreign oil imports could have a major favorable impact upon the United States' adverse balance-of-payments and a major beneficial effect on the U.S. budget and the national debt.

It should be noted that the present invention utilizes some of same the concepts of a system for transporting natural gas from a pipeline to compressed natural gas automotive re-fuel stations, as proposed by the same inventor in patent application Ser. No. 08/454,531, now U.S. Pat. No. 5,603,360, and patent application Ser. No. 08/615,690, now U.S. Pat. No. 5,676,180, to contain natural gas inside a flexible bladder during transportation, or, to store and pressurize natural gas utilizing a hydraulic pump system instead of a more-expensive mechanical compressor system. It is the pressurization method of this invention which makes the technique for re-fueling natural gas vehicles, at home, both effective and economically sound.

Obviously, many modifications and variations of the invention are possible. Further, it is evident that the method and system as described herein meets the objects set forth hereinabove, and that the invention makes possible the re-fueling of natural gas vehicles, at home, and other end-uses.

I claim:

1. A method of providing high-pressure natural gas to re-fuel natural gas vehicles, at home, utilizing a piston-less pressurization chamber to boost low pressure gas from a public utility gas line up to the 3500–4000 psi required for re-fueling, comprising:

providing a seamless, steel, pressure containment vessel which serves as a hydraulic-pressurization chamber whereby the gas is temporarily stored inside a flexible bladder, which is disposed inside said pressure containment vessel, is subjected to pressure in the annulus between said bladder and the steel walls of said pressure containment vessel, said pressure being provided by a hydraulic pump means which is fluidically connected to the annulus, whereby increased pumping increases the hydraulic pressure in the annulus and squeezes the gas out of the bladder to a gas vehicle fueling device, and a conduit means for acquiring gas from the gas line into said flexible bladder.

* * * * *